US005950958A

United States Patent [19]

Eronen

[11] Patent Number: 5,950,958

[45] Date of Patent: Sep. 14, 1999

[54] METHOD IN WINDING OF A WEB, IN PARTICULAR OF A PAPER OR BOARD WEB

[75] Inventor: Pekka Eronen, Järvenpää, Finland

[73] Assignee: Valmet Corporation, Helsinki, Finland

[21] Appl. No.: 09/091,054

[22] PCT Filed: Oct. 22, 1996

[86] PCT No.: PCT/FI96/00558

§ 371 Date: Jun. 10, 1998

§ 102(e) Date: Jun. 10, 1998

[87] PCT Pub. No.: WO98/17564

PCT Pub. Date: Apr. 30, 1998

[30] Foreign Application Priority Data

Oct. 4, 1995 [FI] Finland ..... 954715

[51] Int. Cl.[6] ..... B65H 35/08

[52] U.S. Cl. ..... 242/527; 242/532.3; 242/580; 156/187; 156/270; 156/252

[58] Field of Search ..... 242/521, 527, 242/532.3, 580; 156/184, 185, 187, 247, 269, 270, 252, 257, 464, 517, 519, 522

[56] References Cited

U.S. PATENT DOCUMENTS

| | | |
|---|---|---|
| 3,734,423 | 5/1973 | Kataoka . |
| 3,784,122 | 1/1974 | Kataoka . |
| 4,775,110 | 10/1988 | Welp et al. . |
| 5,092,533 | 3/1992 | Gangemi . |
| 5,222,679 | 6/1993 | Dropczynski et al. . |
| 5,413,656 | 5/1995 | Kühnhold et al. . |

FOREIGN PATENT DOCUMENTS

| | | | |
|---|---|---|---|
| 2177314 | 11/1996 | Canada . | |
| 0744365 | 11/1996 | European Pat. Off. . | |
| 91054 | 10/1987 | Finland . | |
| 97966 | 12/1996 | Finland . | |
| 4029180 | 3/1992 | Germany . | |
| 1313110 | 12/1986 | Japan | 242/580 |
| 3152062 | 6/1991 | Japan | 242/580 |
| 6179552 | 6/1994 | Japan | 242/580 |

*Primary Examiner*—Donald P. Walsh
*Assistant Examiner*—William A. Rivera
*Attorney, Agent, or Firm*—Steinberg & Raskin, P.C.

[57] ABSTRACT

A method and arrangement in winding of a web, in particular a paper or board web, in which the web is wound onto a first roll spool to form a first roll. When the first roll is complete, first and second edges of a material strip having a set length in a running direction of the web are attached to the web at first and second fixing points, respectively, at a location before the web is wound about the first roll spool such that the length of the web between the first and second fixing points is less than the length of the material strip. The first and second edges of the material strip extend in a direction substantially transverse to a running direction of the web. The web is cut between the first and second fixing points after the edges of the material strip are attached to the web at the first and second fixing points and the material strip is severed after the web is cut such that a first portion of the material strip winds about the first roll spool and a second portion of the material strip winds about a new roll spool or equivalent.

20 Claims, 3 Drawing Sheets

METHOD IN WINDING OF A WEB, IN PARTICULAR OF A PAPER OR BOARD WEB

FIELD OF THE INVENTION

The invention concerns a method in winding of a web, in particular of a paper or board web, in which method the web is wound onto a roll spool or equivalent through a nip between a roll or equivalent and the roll spool or equivalent.

BACKGROUND OF THE INVENTION

The machine reel produced in a paper machine is often slit into component webs in a slitter-winder, out of which component webs customer rolls or commercial rolls of desired width are formed. In the commercial rolls formed in the slitter-winder, automatic fixing of the cutting point, i.e. the tail end of the web, to the full roll after winding and the fixing of the initial end of the web to the new roll spool are today ever more important properties in further processing of the paper. This comes from the fact that, at present, ever fewer people work at the slitter-winder, and the roll changes, web threading, and other necessary operations require such a high proportion of the working time of said people that there is hardly time for manual fixing of the final ends/initial ends of the rolls by means of tape or equivalent. Moreover, rolls whose final ends have not been fixed produce difficulties on the conveyors. Likewise, it is a problem that a roll whose final end has not been fixed has time to become loose before packaging.

With respect to the prior art, reference is made to the FI Patent 91,054, in which a method and a device are described for automatic cutting and winding of a product web. In said paper, a solution is also suggested for fixing the end of the web, in which solution the web is weakened and strips of adhesive material are provided at the forward side and at the rear side of the weakening area. However, one problem in this prior-art solution, in particular with thicker paper grades, is ply separation of the paper, i.e. the paper is separated from the roll or spool in spite of the adhesive fixing. Ply separation of paper means that, while the paper is fixed by gluing onto the spool from one side, rigid paper and, especially, board grades tend to straighten themselves to their linear form present on the machine reel and are split starting from the end of the web, in which case the starting of winding can fail completely or a fold is formed on the bottom of the roll. It can also be difficult to find a correct degree of weakening of the web when paper grades of different strengths are run.

OBJECTS AND SUMMARY OF THE INVENTION

The object of the present invention is to provide a method in which the drawbacks of the prior-art solutions are not present and by whose means the ends of the web can be fixed automatically to the roll and to the spool, respectively, simply and reliably.

It is a particular object of the invention to create a solution that is suitable for use in connection with a slitter-winder when the slitter-winder slows down and stops for roll change.

The method in accordance with the invention is mainly characterized in that, in the method, when the roll that is formed on the spool becomes complete, a material strip with one adhesive face is fixed to the web at its edges transverse to the running direction of the web to fixing points so that the edges of the material strip are placed on the web at the fixing points at a distance between said fixing points in the running direction of the web that is shorter than the length of the material strip in the running direction of the web.

According to the invention, a material strip with one adhesive face is fixed to the face of the web, the length of said material strip in the running direction of the web being larger than the distance between its fastening points, and the web is cut off at a suitable point between the fastening points. After this, the material strip with one adhesive face is cut off so that one of its parts fixes the final end of the web to the complete roll and the other part fixes the initial end of the web to a new roll spool or equivalent.

According to the invention, the slitter-winder is stopped for the roll change, and the material strip with one adhesive face, preferably a one-sided tape, is fixed to the face of the web from two zones separate from one another. After this, the web is cut off between the tape fixing points. Since the length of the tape in the running direction of the web is longer than the distance between the fastening points, "unused" tape remains between the ends of the cut-off web. A part of this tape is used for fixing the tail of the roll to the roll, and the rest is used for fixing the web onto the roll spool, respectively.

In an embodiment of the invention the tape has been weakened in advance at the point at which it is supposed to be split between the fastening of the roll tail and the fastening of the web onto the spool.

The fixing by means of the method of the invention is reliable, because it is carried out across the cut-off area, whereby the risk of ply separation is eliminated fully.

BRIEF DESCRIPTION OF THE DRAWINGS

In the following, the invention will be described in more detail with reference to the figures in the accompanying drawing, the invention being, however, in no way supposed to be strictly confined to the details of said illustrations.

DETAILED DESCRIPTION OF THE PREFERRED EMBODIMENTS

Figure 1:
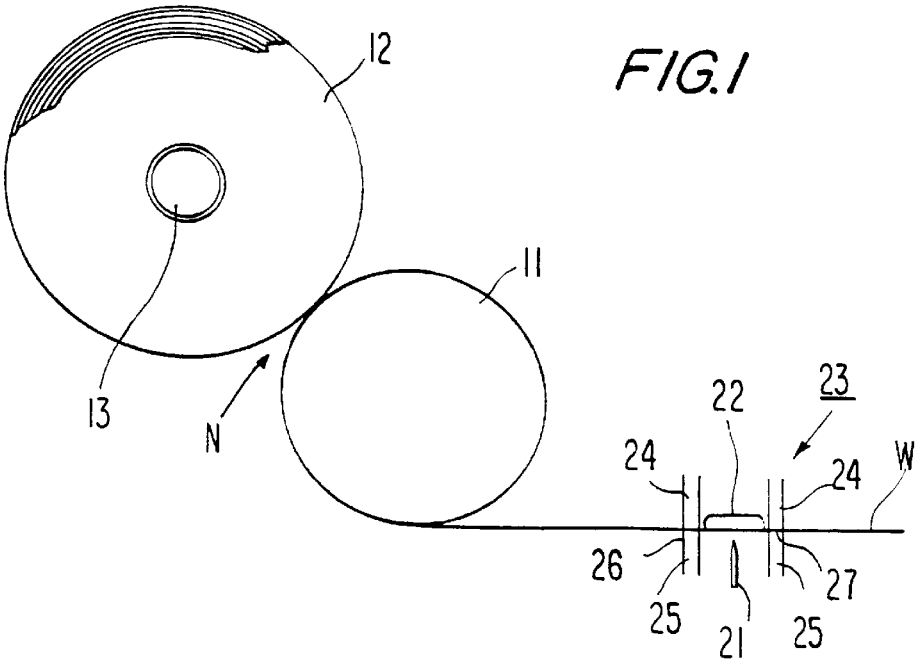
FIG. 1 is a schematic illustration of the stage of the method of the invention in which the slitter-winder has been stopped for the purpose of cutting off the web and fixing the tape.
Figure 2:
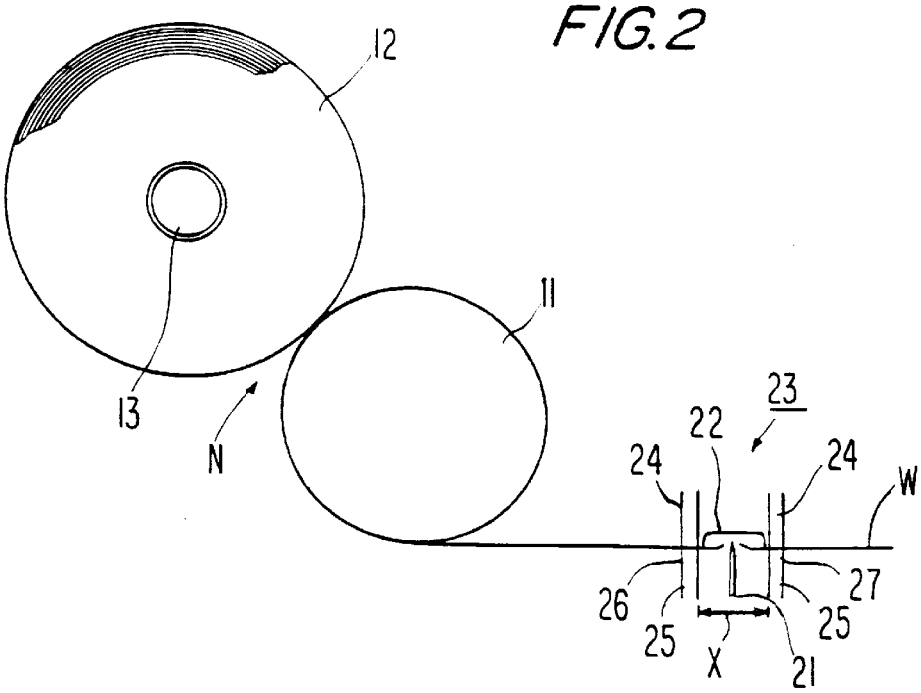
FIG. 2 is a schematic illustration of the stage of the method of the invention in which the web is cut off.
Figure 3:
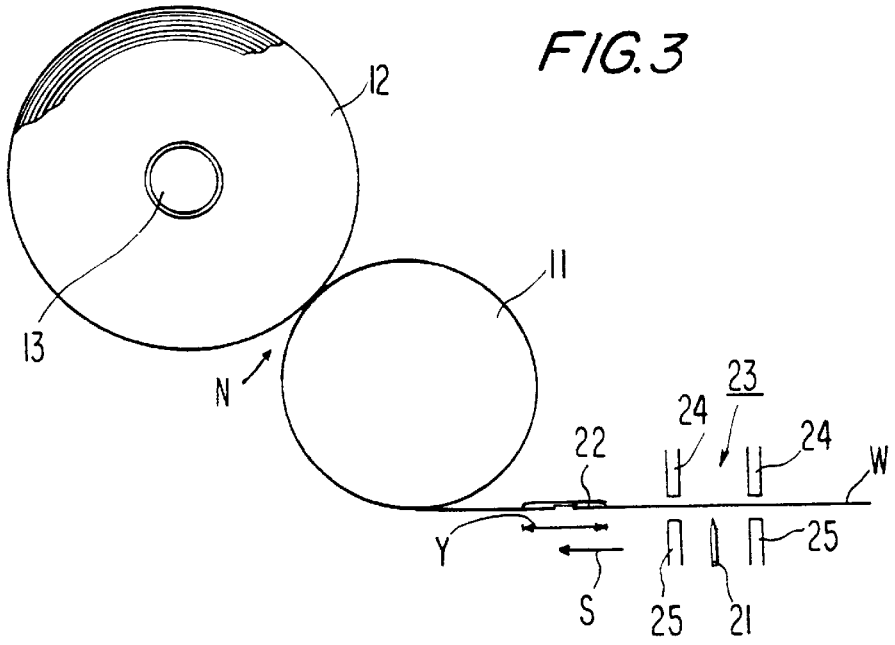
FIG. 3 is a schematic illustration of the stage of the method of the invention in which the web has been cut off and the tape has been fixed between the final portion and the initial portion of the web.

According to FIG. 1, the web W is wound over a roll 11 or equivalent onto the roll spool 13, around which the roll 12 is formed. The winding takes place through the nip N between the roll 11 and the paper roll 12. In the situation as shown in FIG. 1, the web W has been stopped between the upper and lower holding members 24,25 of the web W cutting and tape fixing equipment 23. The tape or equivalent material strip with one adhesive face, to be fixed to the web W, is denoted with the reference numeral 22, and the web W cutting blade with the reference numeral 21. As shown in FIGS. 1 and 3, the length Y of the tape 22 is larger than the length X of the web portion that remains between the tape 22 fixing points 26,27, because the tape 22 has been bent into a curved or equivalent form contact (whereby a middle portion of the tape 22 is not in with the web W);

As shown in FIG. 2, after the ends of the tape 22 have been fixed at the points 26,27 to the web W face, the web 21 is cut off between the fastening points.

After this, as is shown in FIG. 3, the web is moved in the direction S, in which case the tape 22 is tightened between its fixing points and becomes straight, the adhesive face being placed as the bottom face viewed in the direction of the figure.

Figure 4A:
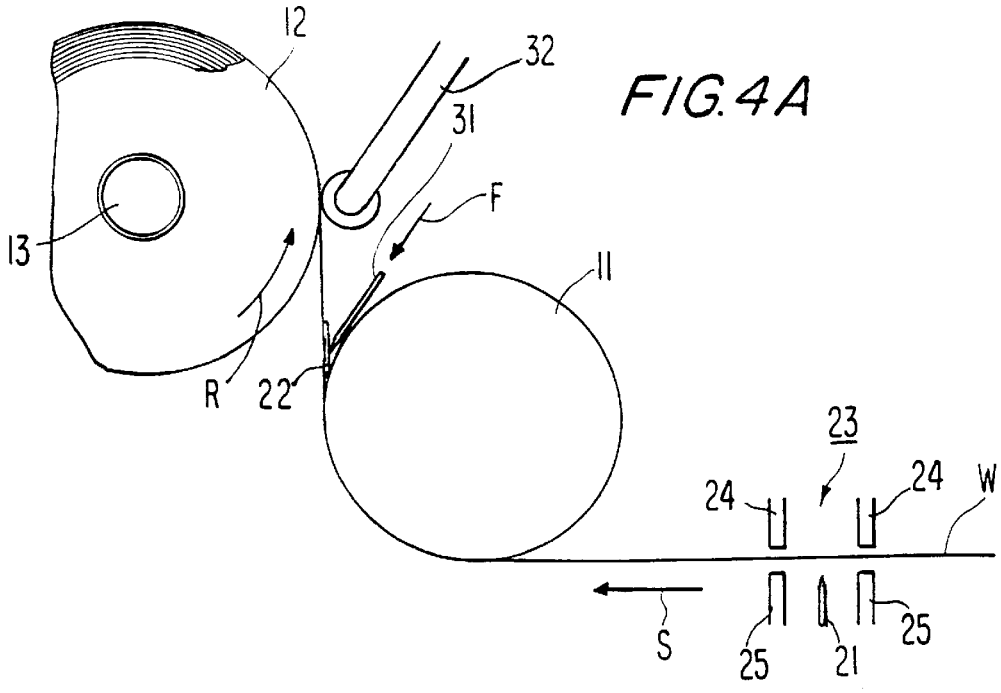
FIG. 4A is a schematic illustration of an exemplifying embodiment of cutting off the tape and fixing the tape to the face of a full roll.

According to the exemplifying embodiment shown in FIG. 4A, in the next stage, when the tape approaches the nip N between the roll 11 and the roll 12, the nip is opened, i.e. the roll 12 shifted to a distance apart from the nip contact with the roll 11, and when the tape is between the roll 11 and the roll 12, the tape is cut off by means of the blade 31, the first part 22A of the tape 22 being guided onto the roll face, and by means of the press member 32 it 22A is pressed into contact with the roll 21 face, whereby the final end of the web has been fixed.

Figure 4B:
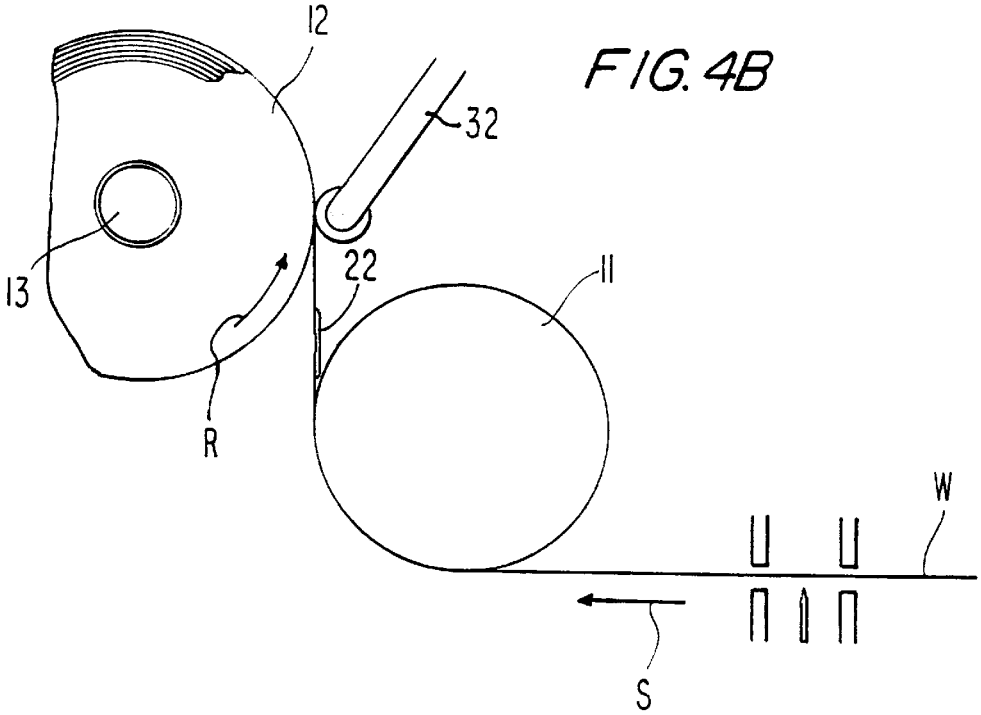
FIG. 4B is a schematic illustration of a second exemplifying embodiment of cutting off the tape and fixing the tape to the face of a full roll.

In the exemplifying embodiment shown in FIG. 4B, the tape 22 has been provided, for example, with a weakening, in which case, when the web W is tightened, the tape 22 is cut off at the weakening. The operations to be carried out after this are similar to those illustrated in FIG. 4A.

Figure 5:
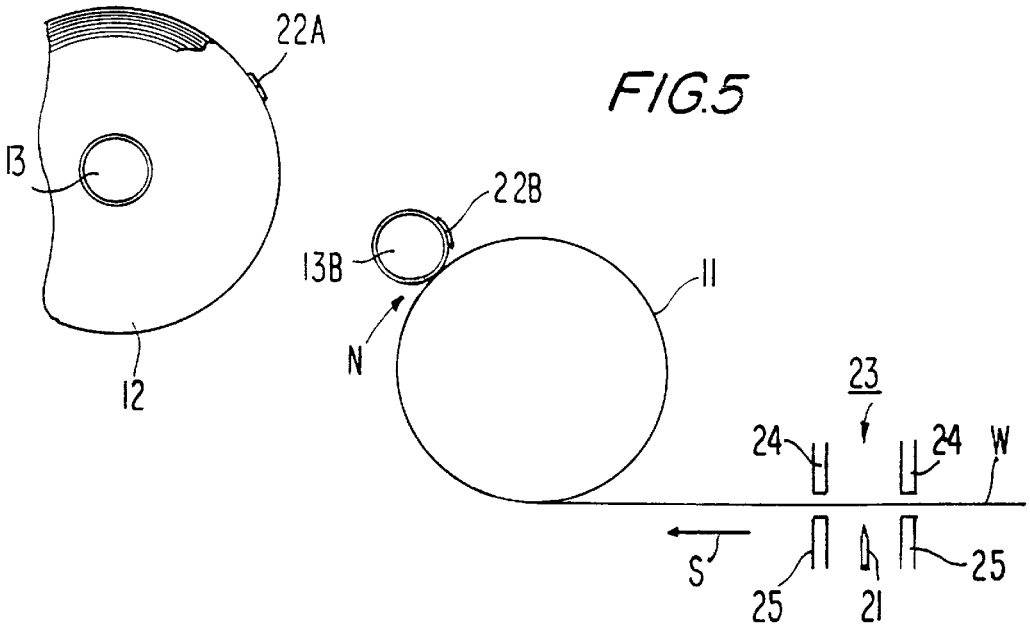
FIG. 5 is a schematic illustration of the stage in the method of the invention in which one part of the tape has fixed the final portion of the web to the face of the complete roll and the other part of the tape has fixed the initial portion of the web onto a new roll spool.

As shown in FIG. 5, after one part 22A of the tape has fixed the final portion of the web W to the complete customer roll, the other part 22B of the tape 22 is fixed to a new roll spool 13B, and after this the winding of the web W is continued onto the new roll spool 13B through the nip N between the roll 11 and the spool 13B. After the roll formed on the spool 13B has reached the desired size, the steps of the method in accordance with the invention are carried out starting from FIG. 1.

Above, the invention has been described with reference to one preferred exemplifying embodiment only, the invention being, however, by no means supposed to be strictly confined to the details of said embodiment.

Many variations and modifications are possible within the scope of the inventive idea defined in the following patent claims.

I claim:

1. A method for changing the winding of a web from a first roll spool about which a first roll is formed to a second roll spool, comprising the steps of:

attaching a first edge of a material strip having a set length in a running direction of the web to the web at a first point at a location before the web is wound about the first roll spool, the first edge of the material strip being oriented in a direction substantially transverse to a running direction of the web, attaching a second edge of the material strip to the web at a second fixing point at a location before the web is wound about the first roll spool such that the length of the material strip between the first and second fixing points is greater than the length of the web between the first and second fixing points, the second edge of the material strip being oriented in a direction substantially transverse to a running direction of the web, cutting the web between the first and second fixing points after the edges of the material strip are attached to the web at the first and second fixing points, and severing the material strip after the web is cut such that a first portion of the material strip winds about the first roll spool and a second portion of the material strip attaches to the second roll spool.

2. The method of claim 1, further comprising the step of:

arranging an adhesive on at least the first and second edges of the material strip such that the first and second edges of the material strip are adhesively attached to the web at the first and second fixing points, respectively.

3. The method of claim 1, further comprising the step of:

stopping the winding of the web onto the first roll spool to thereby stop movement of the web, the first and second edges of the material strip being attached to the web at the first and second fixing points, respectively, while the web is stopped.

4. The method of claim 3, further comprising the step of:

re-starting movement of the web after the web has been stopped and the first and second edges of the material strip have been attached to the web.

5. The method of claim 1, further comprising the step of:

forming a winding nip between the first roll being formed about the first roll spool and a second roll, the web being wound around the second roll, through the winding nip and then about the first roll spool.

6. The method of claim 5, further comprising the step of:

separating the first roll from the second roll after the web has been cut between the first and second fixing points, the material strip being severed when the material strip is between the first roll and the second roll.

7. The method of claim 6, further comprising the step of:

pressing the first portion of the material strip against the first roll by means of a presser member.

8. The method of claim 1, further comprising the step of:

providing the material strip with a weakened area between the first and second edges such that tightening of the web causes the material strip to be severed in the weakened area.

9. The method of claim 1, wherein the step of cutting the web comprises the step of moving a cutting blade against the web at a location between the first and second fixing points.

10. An arrangement for changing the winding of a web from a first roll spool about which a first roll is formed to a second roll spool, comprising:

attaching means for attaching a material strip to the web at a location before the web is wound about the first roll spool, said material strip having first and second edges oriented in a direction substantially transverse to a running direction of the web, said attaching means being arranged to attach said first edge to the web at a first fixing point and said second edge to the web at a second fixing point spaced from said first fixing point a distance less than the length of said material strip in the running direction of the web such that the length of the web between said first and second fixing points is less than the length of said material strip between said first and second fixing points, and cutting means for cutting the web between said first and second fixing points after said first and second edges of said material strip are attached to the web at said first and second fixing points, said material strip being severed after the web is cut such that a first portion of said material strip winds about the first roll spool and a second portion of said material strip attaches to the second roll spool.

11. The arrangement of claim 10, further comprising:

adhesive material arranged on at least said first and second edges of said material strip such that said first and second edges of said material strip are adhesively attached to the web at said first and second fixing points, respectively, said adhesive material being arranged on only one side of said material strip.

12. The arrangement of claim 10, wherein said cutting means comprise a cutting blade arranged between said first and second fixing points.

13. The arrangement of claim 10, wherein a winding nip is defined between the first roll being formed about the first roll spool and a second roll, the web being wound around the second roll, through the winding nip and then about the first roll spool, the first roll being separated from the second roll after the web has been cut between the first and second fixing points, further comprising:

cutting means for severing said material strip when said material strip is between the first roll and the second roll.

14. The arrangement of claim 10, wherein said attaching means comprise an upper holding member and a lower holding member for holding the web at said first and second fixing points in a fixed position such that said first and second edges of said material strip are attached to the web while the web is in a fixed position.

15. The arrangement of claim 10, wherein said first and second edges of the material strip are attached to the web by said attaching means such that a middle portion of the web between said first and second edges is not in contact with the web.

16. A method for changing the winding of a web from a first roll spool about which a first roll is formed to a second roll spool, the web being wound onto the first and second roll spools through a nip formed in part by the first or second roll spool, the method comprising the steps of:

prior to completion of a roll about the first roll spool, attaching first and second edges of a material strip having a set length in a running direction of the web to the web at first and second fixing points, respectively, at a location before the web is wound about the first roll spool, the first and second edges of the material strip being oriented in a direction substantially transverse to a running direction of the web, determining the first and second fixing points such that the length of the material strip between the first and second fixing points is greater than the length of the web between the first and second fixing points, cutting the web between the first and second fixing points after the edges of the material strip are attached to the web at the first and second fixing points, and severing the material strip after the web is cut such that a first portion of the material strip winds about the first roll spool and indicates completion of a roll about the first roll spool and a second portion of the material strip attaches to the second roll spool.

17. The method of claim 16, further comprising the step of:

arranging an adhesive on at least the first and second edges of the material strip such that the first and second edges of the material strip are adhesively attached to the web at the first and second fixing points, respectively.

18. The method of claim 17, wherein only a single side of the material strip includes adhesive.

19. The method of claim 16, further comprising the step of:

forming a winding nip between the first roll being formed about the first roll spool and a second roll, the web being wound around the second roll, through the winding nip and then about the first roll spool, separating the first roll from the second roll after the web has been cut between the first and second fixing points, the material strip being severed when the material strip is between the first roll and the second roll, and pressing the first portion of the material strip against the first roll by means of a presser member.

20. The method of claim 16, further comprising the step of:

providing the material strip with a weakened area between the first and second edges such that tightening of the web causes the material strip to be severed in the weakened area.

* * * * *